US005769012A

United States Patent [19]

Vaughan et al.

[11] Patent Number: 5,769,012

[45] Date of Patent: Jun. 23, 1998

[54] SYSTEM AND METHOD FOR CONTROLLING THE STOPPING POINT OF A TUFTING MACHINE AT A PRESET STOP STEP IN A CARPET STITCH PATTERN

[75] Inventors: William N. Vaughan, White; Douglas L. Morgan, Rome, both of Ga.

[73] Assignee: Shaw Industries, Inc., Dalton, Ga.

[21] Appl. No.: 791,607

[22] Filed: Jan. 31, 1997

[51] Int. Cl.[6] ..... D05C 15/26

[52] U.S. Cl. ..... 112/80.23; 112/277

[58] Field of Search ..... 112/80.01, 80.18, 112/80.23, 102.5, 271, 274, 275, 277, 470.01, 470.02, 475.02

[56] References Cited

U.S. PATENT DOCUMENTS

| | | |
|---|---|---|
| 3,529,560 | 9/1970 | Jackson . |
| 3,762,346 | 10/1973 | Cobble . |
| 3,800,718 | 4/1974 | Johnson . |
| 4,103,635 | 8/1978 | Sedlaczek . |
| 4,151,805 | 5/1979 | Long et al. . |
| 4,586,446 | 5/1986 | Cooper . |
| 4,895,087 | 1/1990 | Amos . |

*Primary Examiner*—Paul C. Lewis
*Attorney, Agent, or Firm*—Brinks Hofer Gilson & Lione

[57] ABSTRACT

A system and method for controlling the stopping point of a tufting machine in relation to a preset stitch pattern. The system includes a controller and an encoder to detect the current location of a tufting machine needle bar in the stitch pattern. Upon receipt of a stop signal, the controller insures that the needle bar is stopped at a preset stop step in the stitch pattern. In a preferred embodiment of the invention, the controller first slows the main drive shaft of the tufting machine to a jogging speed prior to stopping the tufting machine, and stops the machine at the home position of the carpet pattern. Introducing a delay between receipt of the stop signal and deceleration of the main drive shaft minimizes the jogging time of the machine. The method is directed to stopping the tufting machine at a predetermined stop step and at a position relative to degrees of mainshaft rotation.

24 Claims, 7 Drawing Sheets

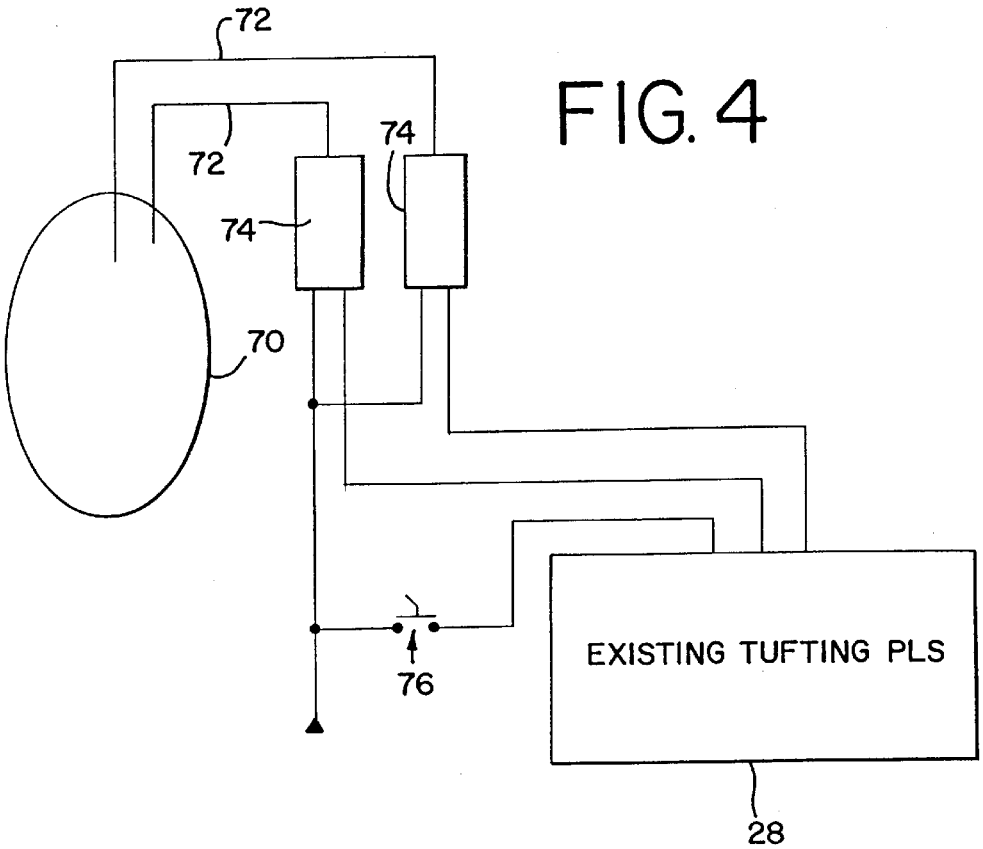
FIG. 4
FIG. 5
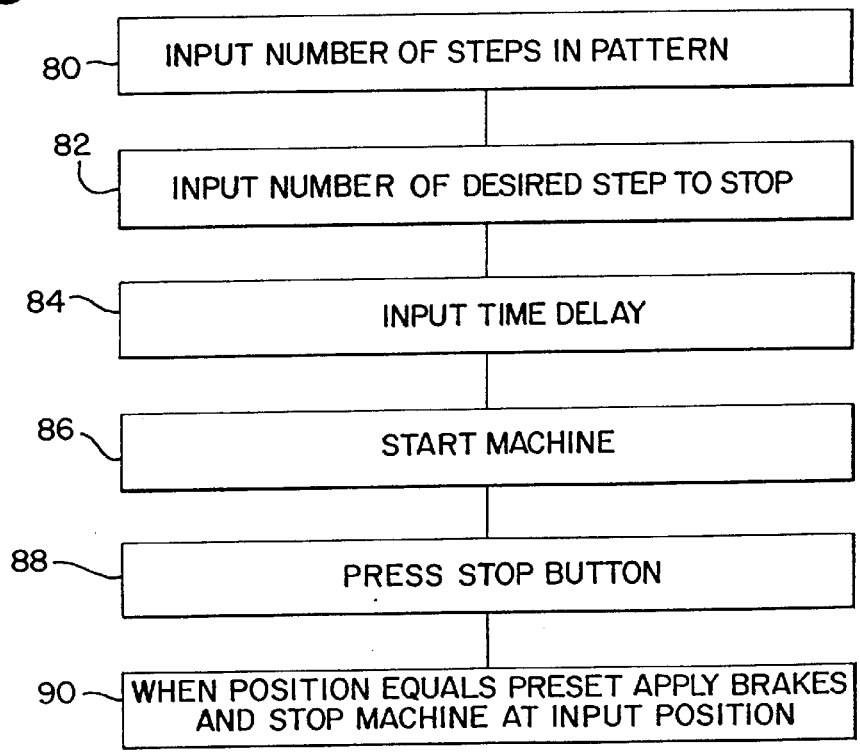

SYSTEM AND METHOD FOR CONTROLLING THE STOPPING POINT OF A TUFTING MACHINE AT A PRESET STOP STEP IN A CARPET STITCH PATTERN

This application is a continuation-in-part of provisional application Ser. No. 60/410,964, Feb. 1, 1996 the contents of which are hereby incorporated by reference herein.

A Microfiche Appendix consisting of 2 sheets (150 total frames) of microfiche is included in this application, the contents of which are hereby incorporated herein by reference. The Microfiche Appendix contains material which is subject to copyright protection. The copyright owner has no objection to the facsimile reproduction by anyone of the Microfiche Appendix, as it appears in the Patent and Trademark Office patent files or records, but otherwise reserves all copyright rights whatsoever.

FIELD OF THE INVENTION

This invention generally relates to controlling the operation of carpet tufting machines, and more particularly, to a system for controlling the stopping position of the needle bar of a tufting machine in a preset carpet stitch pattern.

BACKGROUND OF THE INVENTION

A tufting machine produces carpet through the use of a needle bar assembly containing a plurality of needles. The needles stitch yarn for producing the carpet while one or more needle bars move in a side-to-side motion. At a first position (i.e., "home" position), the needle bar is disposed at a starting location within the carpet stitch pattern. At a second position, the needle bar may be displaced horizontally to the right while stitching the carpet. At a third position, the needle bar may again be displaced to the right. After a series of such steps and stitches of the carpet pattern, the needle bar is displaced horizontally in the opposing direction. After a number of steps have been completed, for example 22 steps, the needle bar will have returned to the home position in the carpet stitch pattern. The above process is repeated to produce tufted loop carpeting. In one common technique, the carpet produced by this process has a series of zig-zag edges due to the horizontal left and right displacement of the needle bar. This horizontal displacement helps alleviate some of the defects produced in the manufacture of the carpet, or creates a desired visual appearance.

During normal operation, a tufting machine operates by rotating a main drive shaft at about 450 to 1150 revolutions per minute. The main drive shaft is coupled either directly or indirectly to the needle bar(s) that stitches the carpet. A programmable logic controller ("PLC") and an inverter drive are commonly used to control the starting and stopping (i.e., drive motion) of the tufting machine. A repeating carpet pattern may be created by a shifting needle bar action produced by a mechanical shifter, hydraulic shifter or other linear displacement mechanism to produce the desired carpet pattern. An encoder detecting system may be employed to track the position of the needle bar assembly within the needle stroke. A count of the steps taken within each pattern can then be communicated by the encoder to a controller. Each time the needle bar completes a pattern cycle, the controller counting the steps is reset.

In the event of yarn breakage or other error condition, the operator of the tufting machine can engage a stop button, or another stop mechanism (i.e., end out detectors) can be engaged, to halt the machine. When the stop signal is received, the operation of the tufting machine typically ramps down to approximately sixty revolutions per minute. This speed is commonly referred to as the "jogging speed" of the machine. Due to the physical momentum introduced by the size of a tufting machine, it may take a series of individual steps for the machine to slow down to reach the jogging speed. For example, where a carpet pattern includes 22 steps and the operator hits the stop button at step 4, it may take 15 steps before the machine reaches the jogging speed. At the jogging speed, therefore, the machine will have progressed to step 19 in the carpet pattern. After reaching the jogging speed, the tufting machine is braked for needed repair or maintenance of the carpet.

When restarting the machine, a defect may be produced along a given line in the carpet because the tension and feeding of the carpet at that line may result in yarn being tighter or looser than before. To reduce the risk of such a defect, the prior art discloses a method of stopping the needle bar at a given height (i.e., relative position of the drive shaft) within the needle stroke. This technique only alleviates some of the risks of a defect. If the machine is stopped at a point which is far away from a preset stop position, defects may also arise even if the needle bar is stopped at the height taught by the prior art. The prior art thus lacks the advantage of stopping the tufting machine at or about a predetermined step in the stitch pattern such as, for example, the next desired stop position, with a minimum number of jog steps, while at the same time stopping the needle bar at a given height within the needle stroke.

It is therefore an object of the invention to stop a carpet tufting machine at a preset stop step in the carpet pattern.

It is also an object of the invention to stop the needle bar of a carpet tufting machine at the next predetermined stop position and at a certain orientation of mainshaft rotation.

It is a further object of the invention to employ a programmable logic controller and encoder to stop a tufting machine at the next home position.

It is yet another object of the invention to minimize the number of jog steps prior to halting the needle bar at the predetermined stop step.

SUMMARY OF THE INVENTION

In view of the above, a system and method are provided for controlling the stopping point of a tufting machine at a preset stop step in a carpet stitch pattern. According to the system of the invention, a tufting machine for forming pile carpet is provided. The tufting machine includes a frame, a main drive shaft housed within the frame and a series of tufting needles mounted on a reciprocating needle bar assembly connected to the main drive shaft so as to be moveable between raised and lowered conditions. The tufting machine also includes a controller configured to the main drive shaft to control the stopping position of the needle bar assembly at a preset stop step in the carpet stitch pattern. A brake coupled to the main drive shaft is included for stopping the main drive shaft at a predetermined position in the carpet stitch pattern in response to the control means. In the preferred embodiment, the predetermined position is the home position and the tufting machine is slowed to a jogging speed prior to stopping the needle bar.

A method for controlling the stopping point of a tufting machine includes the step of receiving a signal to stop the tufting machine. The tufting machine is then slowed, and the needle bar is stopped at a predetermined stop position within the carpet stitch pattern. In the preferred embodiment of the invention, the predetermined stop position is the home position and the tufting machine is slowed to a jogging speed prior to stopping the needle bar.

In another aspect of the invention, the number of jog steps or jog time required before the tufting machine can be stopped is minimized by controlling the deceleration of the main drive shaft. The deceleration is delayed, from receipt of a stop signal, to a time or position when only a minimum number of jog steps are required before the drive shaft is braked to stop at the predetermined stop step.

According to the present invention, defects created by the stopping and starting of a tufting machine can be reduced or eliminated. By locating the stop position of the needle bar at a preset position in the carpet stitch pattern, fewer defects are created once the tufting machine resumes operation. If a defect is created, however, it is less likely to be detected or observed if located at the same position of the carpet stitch pattern every time the machine is stopped and restarted because the severity of the defect may be reduced. By controlling the location where the needle bar is stopped or halted in response to a need for repair or maintenance of the carpet, the appropriate tension for the yarn used in making the carpet can be properly controlled.

These and other features and advantages of the invention will become apparent upon a review of the following detailed description of the presently preferred embodiments of the invention, taken in conjunction with the appended drawings.

BRIEF DESCRIPTION OF THE DRAWINGS

FIG. 4 is an alternate embodiment of the programmable logic controller for use with the invention;

FIG. 5 is a flowchart of the operation of the programmable logic controller;

DETAILED DESCRIPTION OF THE PRESENTLY PREFERRED EMBODIMENTS

Figure 1:
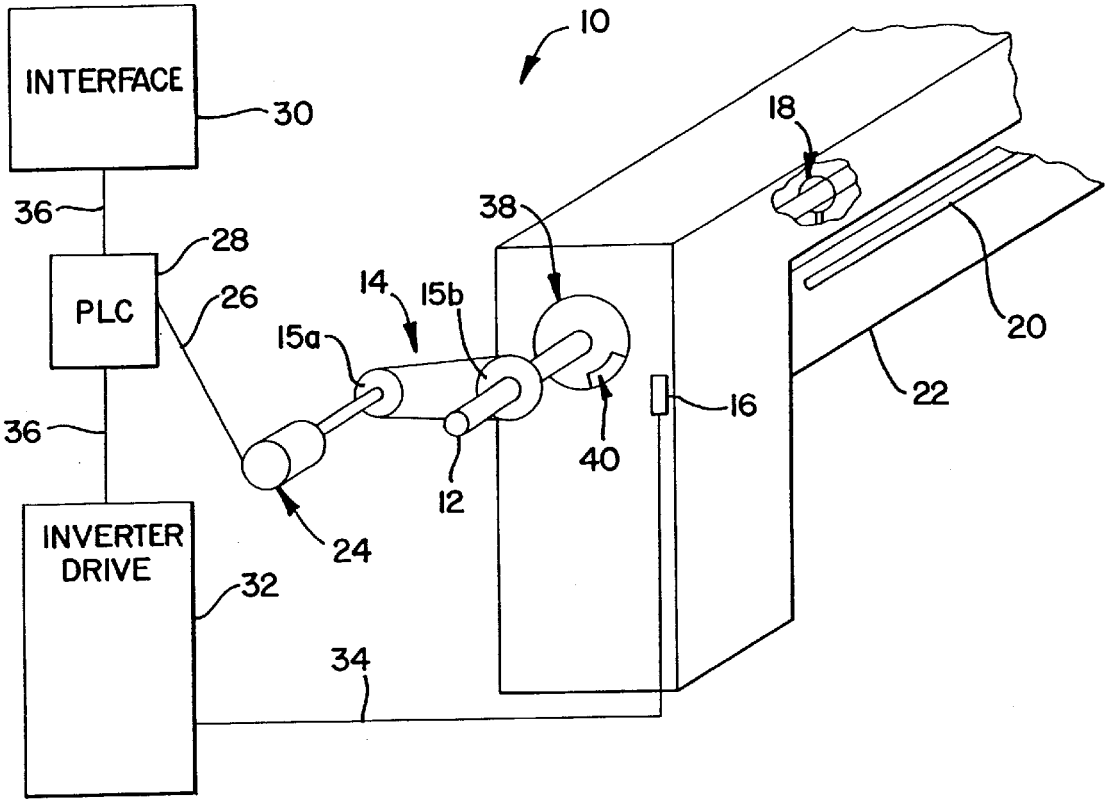
FIG. 1 is a perspective view of a portion of a carpet tufting machine showing the drive mechanism and control circuitry of the invention.

Referring to the drawings, where like reference numerals refer to like objects throughout, a partial view of the pertinent portions of a tufting machine 10 is generally shown in FIG. 1. The tufting machine 10 includes a main drive shaft 12, which extends laterally across the top portion of the tufting machine 10 in a manner generally known in the art. The drive shaft 12 is coupled to a needle drive 18 to control the operation of one or more needle bars 20. Disposed along the length of each needle bar 20 are a plurality of needles 22 used in the formation or stitching of pile carpeting. As the drive shaft 12 rotates, the needle drive 18 causes the needles 22 to move in an up and down (reciprocating) manner to stitch predetermined patterns into rows of tufted loops. The tufted loops are formed from yarn fed into the tufting machine 10 in a manner generally known in the art.

At one end of the drive shaft 12, a mechanical coupling 14 is positioned for communication or translation of drive shaft 12 operation to an encoder 24. As shown in FIG. 1, the mechanical coupling 14 can comprise a belt driven gear system having a driven gear 15*a* and a drive gear 15*b*. The mechanical coupling 14 preferably includes a translation ratio of 1:1, although other translation ratios are contemplated without departing from the spirit and scope of the invention. Further, other systems to translate drive shaft 12 operation to the encoder 24 are envisioned that may not include a translation mechanism, such as resolvers, or optical, magnetic, or other sensors. In such systems, for example, the drive shaft 12 may be directly coupled to the encoder 24.

The encoder 24 is used to monitor operation of the tufting machine 10 by tracking the relative position of the needle bar(s) 20 in a carpet stitch pattern. The encoder 24 preferably comprises a wheel or disk (not shown) mounted on a shaft. The wheel or disk is perforated along its perimeter with one or more apertures. As discussed in more detail below, an electric eye or other light sensitive apparatus is employed to count the rotation of the holes or apertures as the wheel or disk rotates in relation to the drive shaft 12. The count can then be communicated to and translated by the programmable logic controller 28 into a relative position of the needle bar 20. The counting of the holes by the programmable logic controller 28 enables monitoring the location of the needle bar 20 in the carpet stitch pattern and thus operation of the tufting machine 10.

The information obtained by the encoder 24 is communicated to the programmable logic controller 28 by means of a communication link 26. Preferably, the programmable logic controller 28 comprises a Toshiba II PLC. As discussed in more detail below, the programmable logic controller 28 is programmed to operate the tufting machine 10 to stop at a predetermined stop step in the step pattern. The programmable logic controller 28 accordingly controls the stopping of the tufting machine 10 in a manner to reduce or eliminate defects in the carpet being produced.

The system further includes an interface 30 that allows for operator supervision of the tufting machine 10. According to the preferred embodiment of the invention, the interface 30 comprises an industrial computer, model no. SB586P/100, manufactured by Industrial Computer Source of San Diego, Calif. (described in detail below in connection with FIG. 7). Alternatively, the interface 30 can comprise a Panelmate Operator Interface manufactured either by Eaton Corporation or Modicon Corporation (described below in connection with FIG. 6). The interface 30 facilitates the set-up, calibration and programming of the tufting machine 10 to stop the needle bar 20 at a predetermined position (and orientation) in the carpet stitch pattern. According to the preferred embodiment of the invention, the predetermined position is the home position of the carpet stitch pattern, however, any preset stop position within the step count of the carpet stitch pattern can be employed without departing from the spirit and scope of the invention. The interface 30 is coupled to the programmable logic controller 28 and an inverter drive 32 via a coupling 36. The coupling 36 is an electrical coupling for the communication of signals between the programmable logic controller 28, the interface 30 and the inverter drive 32. As those skilled in the art will appreciate, however, other couplings can be employed and are contemplated.

The inverter drive 32 preferably receives a signal from the programmable logic controller 28 to stop the tufting machine 10. Upon receipt of a stop signal, the inverter drive 32 communicates a signal over the solenoid link 34 to a solenoid 16 mounted on the tufting machine 10. The signal communicated to the solenoid 16 operates to engage a brake pad 40 and a brake disk 38 coupled to the drive shaft 12. In this manner, the tufting machine 10 can be stopped at the predetermined position in the stitched carpeting. In the preferred embodiment, the inverter drive 32 receives both a signal to slow and another signal to stop the tufting machine 10 in an effort to reduce the number of jog steps that may occur. By properly sequencing and controlling the generation of these signals, the needle bar(s) 20 can be slowed to the jogging speed and stopped at the next predetermined position.

In the preferred embodiment of the invention, the programmable logic controller 28 generates a signal to begin deceleration of the needle bar(s) 20. In order to minimize the number of jog steps required after the needle bar 20 has slowed and before the predetermined stop position is reached, a predetermined deceleration stitch position can be programmed into the programmable logic controller 28 to delay deceleration until that position is reached. Preferably, the delay is set to take into account the minimum number of deceleration stitches or steps required for a given tufting machine 10, at a certain speed, plus one or more jog stitches if necessary. A reduction or elimination in jog time is acheived, therefore, by delaying the generation of the deceleration signal after the operator engages the stop button (not shown) to take into account the number of steps to the next predetermined stop position.

Upon restarting of the tufting machine 10, the inverter drive 32 communicates a start signal over the solenoid link 34 to the solenoid 16. In response to the start signal, the solenoid 16 disengages the brake disk 38 and brake pad 40, thus allowing resumed rotation of the drive shaft 12. In the preferred embodiment of the invention, the drive shaft 12 is stopped consistently at the same orientation every time. Preferably, the solenoid 16 comprises an air solenoid although other forms of solenoids, and other forms of braking systems, can be employed as those skilled in the art will appreciate.

Figure 2:
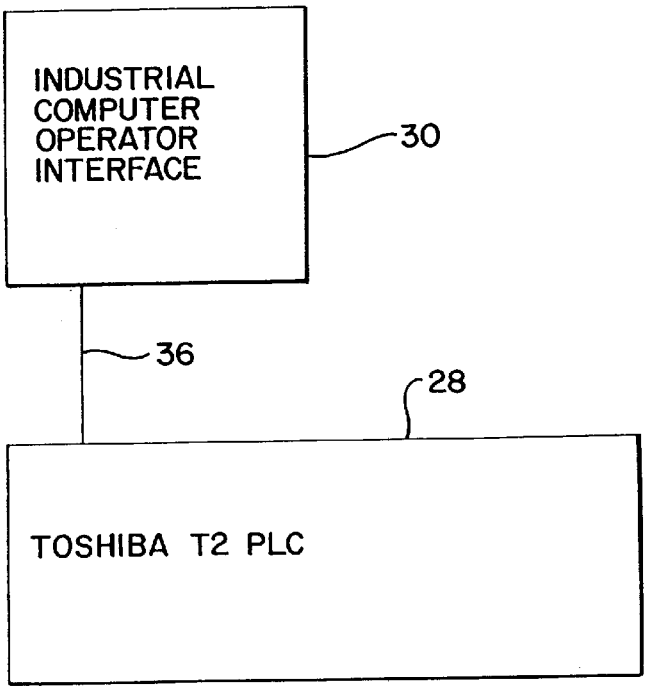
FIG. 2 is a block diagram of a programmable logic controller and interface for use with the invention shown in FIG. 1.

Referring now to FIG. 2, a block diagram of the control elements of the system is shown. As illustrated, the interface 30 is coupled via the coupling 36 to the programmable logic controller 28. As mentioned above, the programmable logic controller 28 is programmed to properly synchronize the stopping and starting of the tufting machine 10. As discussed in more detail below in connection with FIG. 5, two alternate control programs for the programmable logic controller 28 are included in the Microfiche Appendix . The programs provided in the Microfiche Appendix are presented in a "ladder logic" format generally known in the art for programming programmable logic controllers of the type employed herein.

Figure 3:
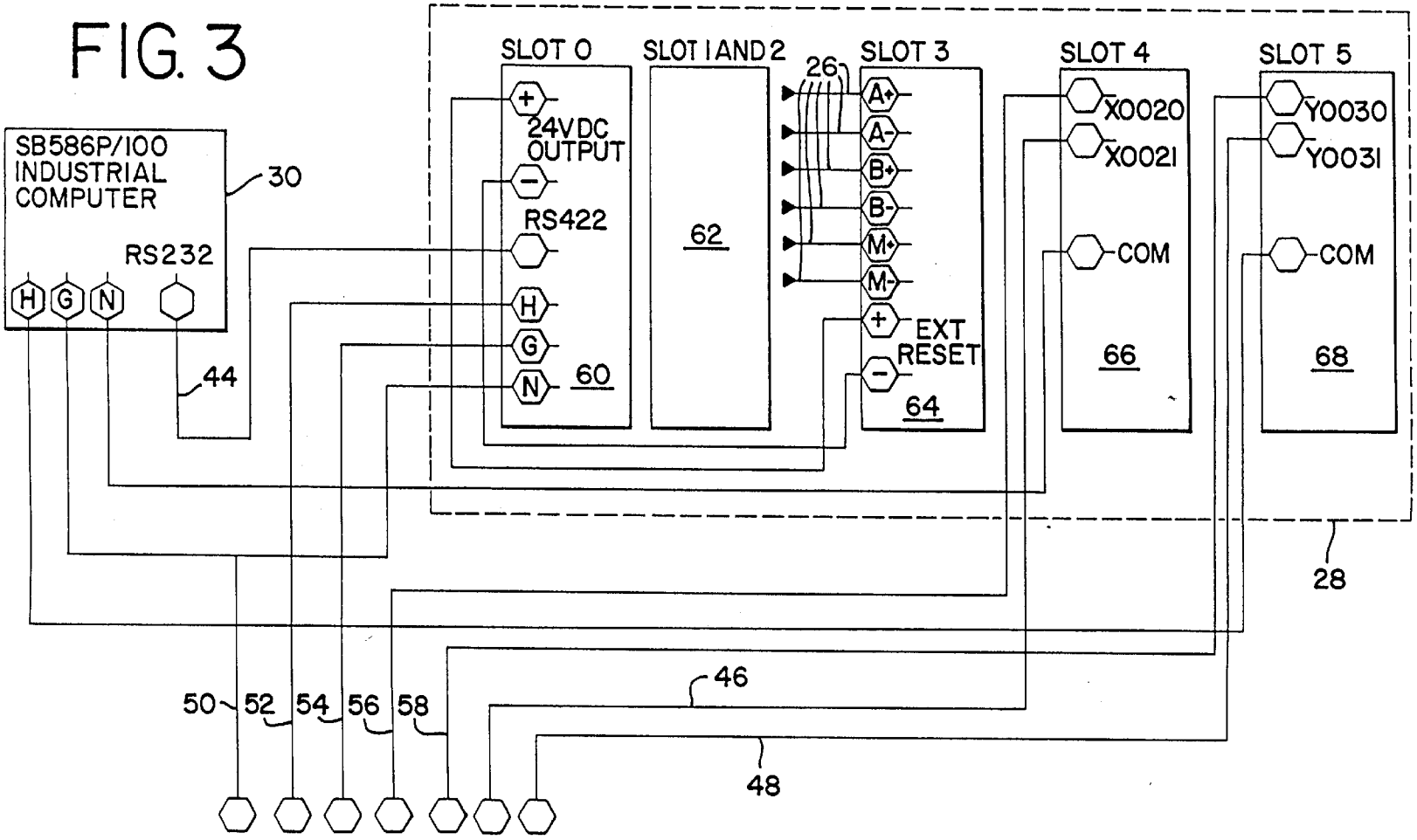
FIG. 3 is a detailed block diagram of the preferred programmable logic controller shown in FIG. 2.

An expanded block diagram of the system shown in FIG. 2 is provided in FIG. 3. As can be seen, a plurality of signals are communicated over the coupling 36 between the interface 30, the programmable logic controller 28 and the tufting machine 10. These signals comprise an RS-232 compatible serial communication link 44, as well as a ground signal 50, a voltage reference 52, a neutral reference signal 54, a slow speed reference input signal 56 and a stop signal output 58. Preferably, the voltage reference signal 52 is the standard 110-volt signal of alternating current used in the United States. The slow speed reference input signal 56 is received from the inverter drive 32 over the communication link 36. The stop signal output 58 is communicated to the tufting machine 10 via the solenoid link 34. In addition, an input 46 communicates a signal received upon engagement of the stop button (not shown). An output 48 is also provided, which communicates a deceleration signal to the inverter drive 32 that can be delayed to minimize jogging time, as described above. In the preferred embodiment, the need and magnitude of any delay is determined by the programmable logic controller 28.

As shown in FIG. 3, the programmable logic controller 28 includes a power supply 60, a central processor ("CPU") 62, a high speed counter module 64, an input module 66 and a relay output module 68. According to the preferred embodiment, the power supply 60 comprises a Toshiba #TTS261-S power supply; the CPU 62 comprises a Toshiba #TTU224-S central processor unit; the high speed counter module 64 comprises a Toshiba #EX10-MPI21 pulse modulator; the input module 66 comprises a Toshiba #EX10-MIN51 110-volt AC input module; and the relay output module 68 comprises a Toshiba #EX10-MRO61 relay module. The above elements are preferably housed within a Toshiba #TBU266-S frame or rack (not shown).

As mentioned above, the location of the needle bar 20 is monitored by the encoder 24 and communicated to the programmable logic controller 28. A signal is therefore generated by the encoder 24 that represents the counting or positioning of the needle bar 20 and needles 22 within the preset carpet stitch pattern. This signal is communicated over the communications link 26 to the programmable logic controller 28. As shown in FIG. 3, some of the signals are directly communicated to the high speed counter module 64. Once the number of positions within the preset carpet stitch pattern is programmed into the programmable logic controller 28 (see below), the position of the needle bar 20 and needles 22 can be determined as a relative position within the stitch pattern. Having the position of the needle bar 20 and needles 22, the programmable logic controller 28 can cause the needle bar 20 to stop at the predetermined stop position each time a stop signal is received. A detailed description of the programming of the programmable logic controller 28 is provided below in connection with FIG. 6.

Referring now to FIG. 4, one alternate preferred embodiment for tracking and determining the position of the needle bar(s) 20 is shown. According to the alternate embodiment, a cam 70 is mounted on or coupled to the drive shaft 12 of the tufting machine 10. Two fiber optic cables 72 are positioned in optical proximity to the cam 70. The fiber optic cables 72 are coupled at their distal ends to photosensors 74, which are in turn coupled to the programmable logic controller 28. The fiber optic cable 72 is preferably manufactured by Banner Engineering Corporation, part no. MQDC-315RA. The fiber within the fiber optic cable 72 is also manufactured by Banner Engineering Corporation, part no. PIT26U, as are the photosensors 74, part no. SM2A312FPQD. A two-position switch 76 is employed to allow for either manual or automatic operation of the system. Preferably, the switch (part no. 52SA2AAB) is disposed on a testing machine (not shown) and mounted on a no-contact block (part no. BAK).

The alternate embodiment shown in FIG. 4 preferably operates at 110-volts AC, and directly senses through the photosensors 74 the rotation and/or positioning of the cam 70. In one embodiment, the cam 70 can include perforations along its perimeter, as described above. Alternately, other markings can be disposed on the cam 70, which are sensed or detected by the photosensors 74, or relative linear displacement may be monitored. This information is coupled to the programmable logic controller 28 to count electrical/optical pulses received from the photosensors 74 in the manner described above. The programmable logic controller 28 can thus locate the position of the needle bar 20 and can control stopping the needle bar 20 at the predetermined position.

A flow chart identifying the sequence of steps for controlling the tufting machine 10 is shown in FIG. 5. At step 80, the number of steps in the preset carpet stitch pattern is programmed into the programmable logic controller 28. At step 82, the number of steps desired prior to stopping the needle bar 20 is also inputted. (This allows for the preferred slowing of the tufting machine 10 to the jogging speed.) A delay time may also be inputted at step 84. At step 86, the tufting machine 10 is started. The machine 10 continues operation until receipt of a stop signal. Once the stop signal has been detected at step 88, the program slows the tufting machine 10 at step 90, and generates a braking signal to stop the machine 10 at the preprogrammed position.

Figure 6A:
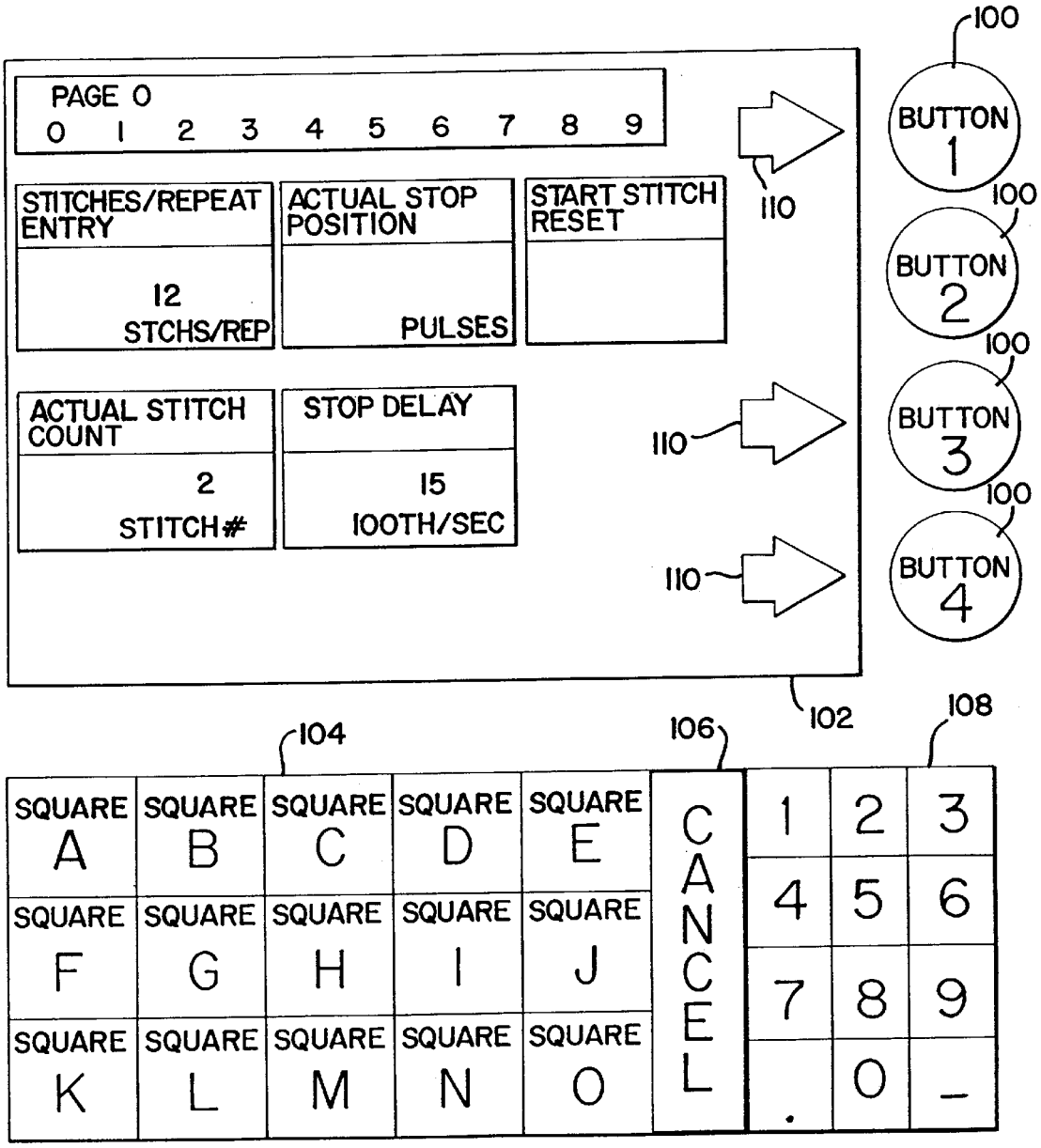
FIG. 6 is a plan view of a control panel used with the interface, where FIG. 6(*a*) shows a first panel display and FIG. 6(*b*) shows a second panel display.
Figure 6B:
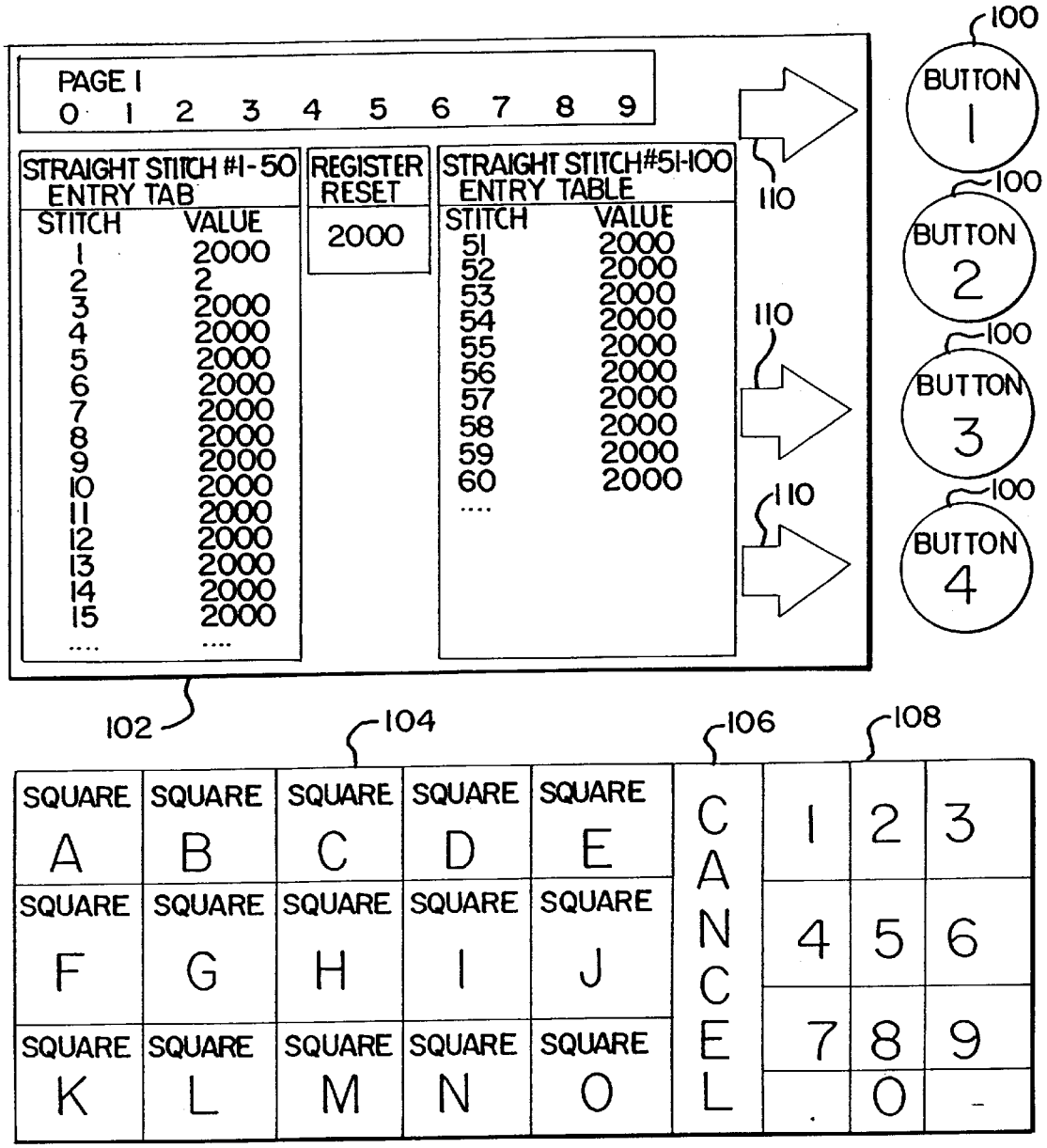

Referring to FIG. 6, one control panel for use with the interface 30 is shown. The control panel is employed with a Precision Needle Positioner and Data Key Encore System manufactured by Tuftco. Prior to use of the Precision Needle Positioner, the system should be properly set-up and calibrated. To set-up and calibrate the system, the tufting machine 10 is preferably set for a straight stitch pattern and the machine 10 is jogged until the needles 22 are disposed at the top of their stroke. A pattern key is then inserted and a step pattern is loaded. A calibration key (not shown) is employed while determining the next step using the back bar (not shown) of the tufting machine 10. Once the next step is determined for the carpet stitch pattern, it will remain the same each time the particular pattern is loaded. Accordingly, the number of stitches per repeat, any stitch correction, the number of stitches to stop on in a straight stitch register, and a stop delay can then be entered or computed. The tufting machine 10 is next jogged to verify that the Precision Needle Positioner and the tufting machine 10 are in calibration. The tufting machine 10 can then be started and stopped as described above. If defects (i.e., stop marks) are visible as a result of such stopping and restarting of the machine 10, they can preferably be corrected by adding advance if the defect is low or subtracting advance if the defect is high.

As shown, FIG. 6(*a*) illustrates a first page (e.g., page 0) of the control panel, and FIG. 6(*b*) shows a second page (e.g., page 1) of the same control panel. Both panels include input buttons 100, and a display area 102. The display area 102 identifies the page number, as well as specific information about the stitch pattern. This information includes the data entered or determined through the calibration steps described above. As shown in FIG. 6(*b*), the display area 102 includes page information as well as an entry table for the particular stitch pattern programmed into the tufting machine 10. Input squares 104, a cancel button 106, and a numeric keypad 108 are also provided at the bottom of each panel shown in FIGS. 6(*a*) and 6(*b*). Both of the panels shown in FIGS. 6(*a*) and 6(*b*) also include arrows 110 that point to the input buttons 100 according to the program in a manner generally known in the art. A set of instructions for setting-up, calibrating, and programming the tufting machine 10 using this interface 30 is included in the Microfiche Appendix, along with a configuration file for one typical carpet stitch pattern.

Figure 7A:
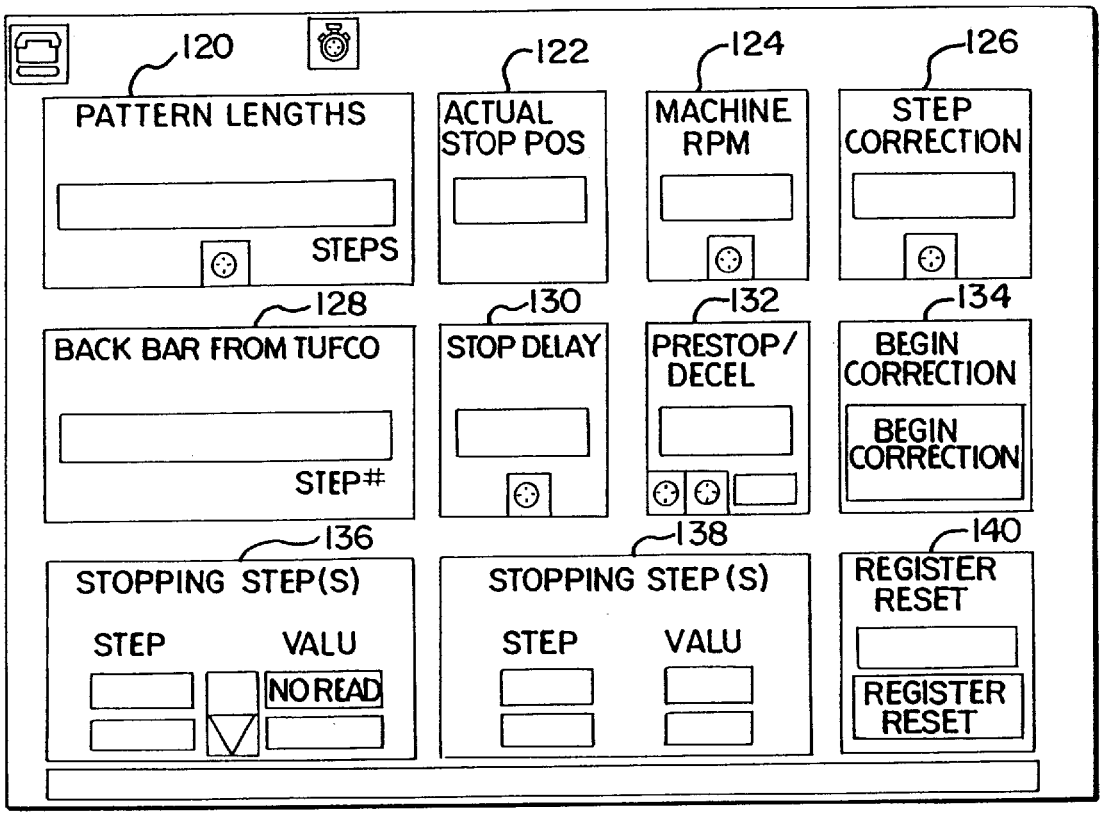
FIG. 7 is a plan view of a graphic user interface for use with a presently preferred industrial computer, where FIG. 7(*a*) shows a pattern programming screen, FIG. 7(*b*) lists the stopping steps of a programmed carpet pattern, and FIG. 7(*c*) lists the programmed deceleration stitches.
Figure 7B:
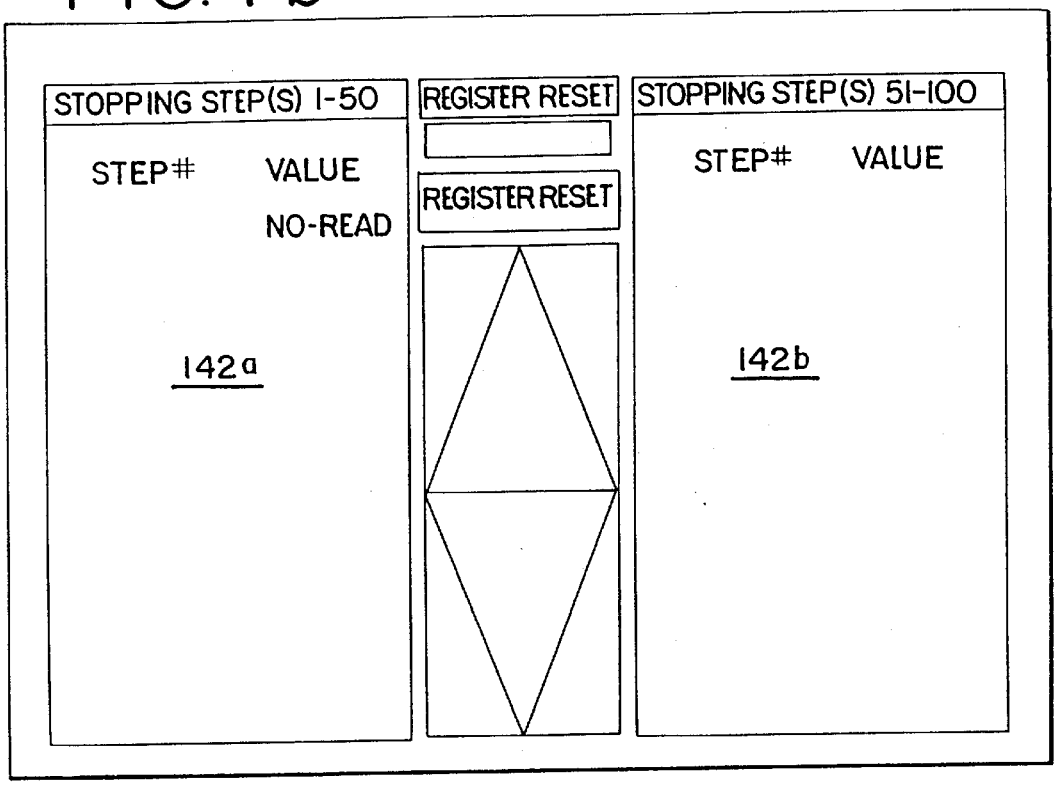
Figure 7C:
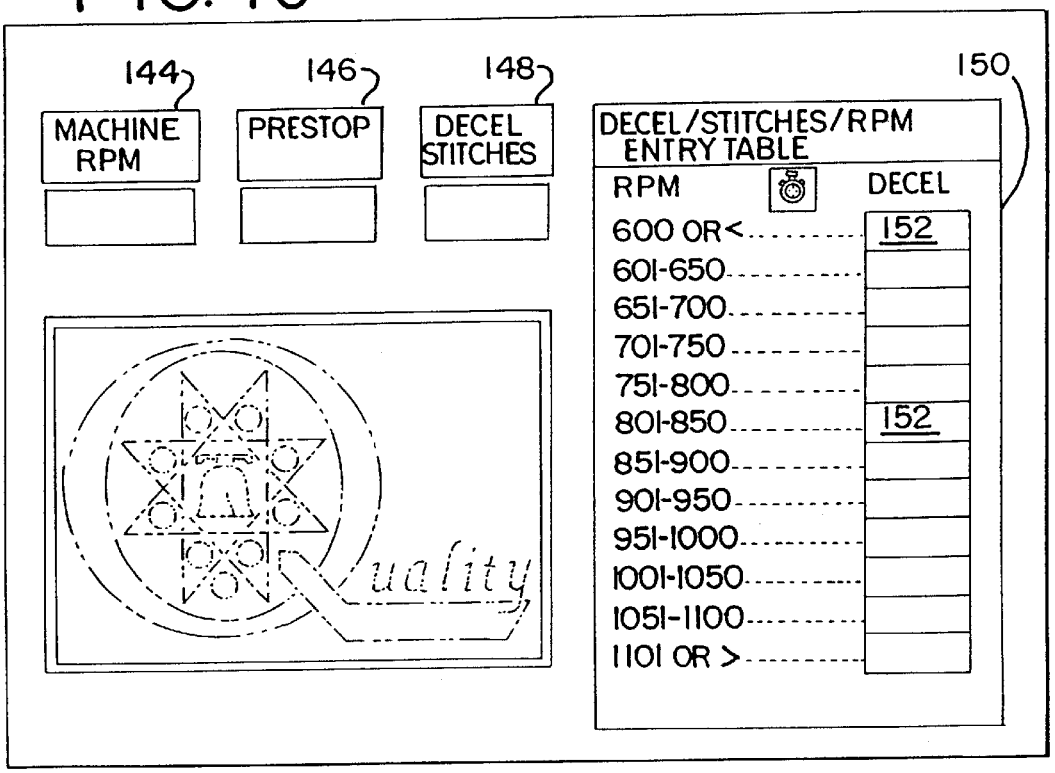

Referring now to FIG. 7, a plan view of the presently preferred graphic user interface for use with the preferred industrial computer is shown. The graphic user interface is provided on a visual display screen (not shown) such as a cathode ray tube, liquid crystal or other display generally known in the art. In FIG. 7(*a*), a pattern programming screen is provided having a pattern length window 120. A user or operator can input or program a particular carpet pattern length by providing the number of steps through an input device (not shown). As those skilled in the art will appreciate, such input devices can include keyboards, numeric keypads, or the like, and are generally known in the art. The input pattern thus appears and is displayed in the pattern length window 120. An actual stop position is displayed in the actual stop position window 122 according to the relative position of main drive shaft 12 rotation in number of pulses. Additional windows are provided to receive a machine speed 124, a step correction 126, a back bar step 128, a stop delay 130, a prestop/deceleration 132, a begin correction 134, a stopping step 136 and 138, and a register reset 140.

As described above, by properly selecting the above variables the user or operator can program the programmable logic controller 28 to generate and/or delay the deceleration and stop signal for communication to the tufting machine 10. The actual stop position window 122 receives the pre-programmed stop step. Based on the revolutions per minute provided in the machine speed window 124 and the value included in the step correction window 126 a stop delay value and a deceleration value can be calculated and displayed in windows 130 and 132. The number of stopping steps can be inserted by the user or operator and is displayed in windows 136 and 138. The programmable logic controller 28 can thus determine when to begin deceleration of the tufting machine 10.

As shown in FIG. 7(*b*), the stopping steps can be displayed to the operator through stopping step windows 142*a*, 142*b*. A step number and a value for that step is thus displayed to the operator. On the left hand side of the display 142*a* stopping steps 1–50 are listed, and on the right hand side of the display 142*b* stopping steps 51–100 are listed (for carpet patterns having 100 or fewer steps).

Referring now to FIG. 7(*c*), a second machine speed window 144, a prestop window 146, and a deceleration and jog stitches window 148 are displayed. Based upon the particular machine speed and the programmed prestop value, the number of deceleration stitches can be determined. A window 150 is provided that lists the number of deceleration and jog stitches 152 necessary according to the relative speed of the tufting machine 10. Accordingly, the step at which deceleration begins can be controlled and delayed by the programmable logic controller 28 in order to minimize or reduce the amount of jogging time required by the tufting machine 10. A presently preferred computer program listing for control and operation of these functions on the preferred industrial computer is included in the Microfiche Appendix.

As can be seen, the present invention allows for stopping a carpet tufting machine at a predetermined stop position of a preset carpet stitch pattern. The tufting machine can be preferably programmed and controlled to stop at the predetermined stop position when a stop signal is received independent of the current needle bar position. By stopping the needle bar at the predetermined stop position, and at a specific orientation, defects produced when restarting the tufting machine are greatly reduced or eliminated. Moreover, defects that do occur are better hidden and less noticeable if they occur at the same selected stop step of the stitch pattern every time. Introducing a delay between operator engagement of the stop control and the deceleration of the tufting machine also minimizes the number of jog steps initiated or required.

It is to be understood that a wide range of changes and modifications to the embodiments described above will be apparent to those skilled in the art and are contemplated. It is therefore intended that the foregoing detailed description be regarded as illustrative, rather than limiting, and that it be understood that it is the following claims, including all equivalents, that are intended to define the spirit and scope of this invention.

We claim:

1. In a tufting machine for forming pile carpet according to a stitch pattern comprised of a predetermined number of steps said machine having a frame, a main drive shaft housed within the frame, a plurality of tufting needles mounted on a reciprocating needle bar assembly operatively connected to said main drive shaft so as to be moved by one revolution of said main drive shaft from a raised position to a lowered position and back to the raised position in each step, a needle bar shifter that displaces the needle bar horizontally from a home position in accordance with the stitch pattern, a yarn feed system operatively connected to said main drive shaft for feeding yarns to said plurality of needles and drive means for driving said main drive shaft so as to feed yarn and successively form rows of tufted loops from the yarns, the improvement comprising:

control means for controlling the stopping of the tufting machine at a preset stop step in the stitch pattern, the preset stop step being selected in relation to the horizontal displacement of the needle bar, and with the needle bar in the raised position; and brake means operatively connected to said main drive shaft for stopping said main drive shaft in response to said control means.

2. The tufting machine defined in claim 1, further comprising means for determining the location of the needle bar in the stitch pattern.

3. The tufting machine defined in claim 1 wherein the preset stop step is selected so as to have the needle bar in the home position.

4. The tufting machine defined in claim 1, further comprising means for stopping the needle bar in response to a signal, the needle bar being consistently stopped at the same place and same orientation of drive shaft revolution.

5. The tufting machine defined in claim 1, further comprising means for slowing the needle bar to a jogging speed.

6. A tufting machine for forming pile carpet according to a stitch pattern comprised of a predetermined number of steps, the tufting machine comprising:

a frame;

a main drive shaft housed within the frame;

a plurality of tufting needles mounted on a reciprocating needle bar operatively connected to said main drive shaft so as to be moved by one revolution of said main drive shaft from a raised position to a lowered position and back to the raised position in each step;

a needle bar shifter that displaces the needle bar horizontally from a home position in accordance with the stitch pattern;

a controller operatively connected to the main drive shaft to control the stopping of the needle bar at a preset stop step in the stitch pattern, the preset stop step being selected in relation to the horizontal displacement of the needle bar, and with the needle bar in the raised position; and a brake coupled to the main drive shaft for stopping the main drive shaft with the needle bar in the preset stop step.

7. The tufting machine defined in claim 6, further comprising an encoder for locating the position of the needle bar in the stitch pattern.

8. The tufting machine defined in claim 6, further comprising an inverter coupled to the controller, the inverter to start operation of the main drive shaft upon receipt of a starting signal.

9. The tufting machine defined in claim 6, further comprising means coupled to the main drive shaft for gradually engaging the main drive shaft upon starting the tufting machine.

10. The tufting machine defined in claim 6, further comprising means for slowing the tufting machine to a jogging speed.

11. The tufting machine defined in claim 6, wherein the the preset stop step is selected so as to have the needle bar in the home position.

12. A method for controlling the stopping point of a tufting machine needle bar adapted to be raised and lowered in each step and displaced horizontally according to a stitch pattern comprised of a predetermined number of steps, the method comprising the steps of:

selecting a preset stop step in the stitch pattern in relation to the horizontal displacement of the needle bar and with the needle bar raised;

running the needle bar through repetitions of the stitch pattern;

generating a signal to stop the needle bar;

braking the tufting machine in response to the signal to stop the tufting machine so as to stop the needle bar at the preset stop step.

13. The method defined in claim 12, further comprising the step of slowing the tufting machine to a jogging speed prior to stopping the needle bar at the preset stop step.

14. The method defined in claim 12, further comprising the step of restarting the tufting machine.

15. The method defined in claim 12, wherein the preset stop step is selected so as to have the needle bar in the home position.

16. The method defined in claim 12, wherein the needle bar is raised and lowered by revolution of a drive shaft and the needle bar is stopped at a predetermined orientation of revolution of the drive shaft.

17. A tufting machine for forming pile carpet, according to a stitch pattern comprised of a predetermined number of steps, the tufting machine comprising:

a frame;

a main drive shaft housed within the frame;

a plurality of tufting needles mounted on a reciprocating needle bar assembly operatively connected to said main drive shaft so as to be moved by one revolution of said main drive shaft from a raised position to a lowered position and back to the raised position in each step;

a needle bar shifter that displaces the needle bar horizontally from a home position in accordance with the stitch pattern;

a controller operatively configured to the main drive shaft to control the stopping of the needle bar assembly at a preset stop step in the stitch pattern, said preset stop step selected in relation to the horizontal displacement of the needle bar, and with the needle bar in the raised position;

means for controlling the deceleration of the main drive shaft; and a brake coupled to the main drive shaft, the brake for stopping the main drive shaft at the preset stop step.

18. The tufting machine defined in claim 17, further comprising an encoder for locating the position of the needle bar in the stitch pattern.

19. The tufting machine defined in claim 17, further comprising an inverter coupled to the controller, the inverter to start operation of the main drive shaft upon receipt of a starting signal.

20. The tufting machine defined in claim 17, further comprising means coupled to the main drive shaft for gradually engaging the main drive shaft upon starting the tufting machine.

21. The tufting machine defined in claim 17, further comprising means for slowing the tufting machine to a jogging speed.

22. The tufting machine defined in claim 17, wherein the preset stop step is selected so as to have the needle bar in the home position within the stitch pattern.

23. The tufting machine defined in claim 17, wherein the means for controlling deceleration introduces a delay to said deceleration of the main drive shaft.

24. The method defined in claim 12 wherein the step of controlling deceleration of the tufting machine further comprises the step of delaying said deceleration.

* * * * *